United States Patent [19]

Pages

[11] Patent Number: 4,898,140

[45] Date of Patent: Feb. 6, 1990

[54] DEVICES FOR ELIMINATING WATER FROM DIESEL OIL SUPPLYING A DIESEL ENGINE

[75] Inventor: Jean Pages, Epinay sur Seine, France

[73] Assignee: Labinal, Montigny le Bretonneux, France

[21] Appl. No.: 335,502

[22] Filed: Apr. 10, 1989

[30] Foreign Application Priority Data

Apr. 11, 1988 [FR] France ..... 88 04760

[51] Int. Cl.[4] ..... F02M 39/00

[52] U.S. Cl. ..... 123/510; 123/514; 137/558

[58] Field of Search ..... 123/510, 514, 25 R, 123/516, 179 L; 137/557, 558, 565; 210/DIG. 5, 172, 167, 114

[56] References Cited

U.S. PATENT DOCUMENTS

| | | | |
|---|---|---|---|
| 3,279,380 | 10/1986 | Clark | 137/558 |
| 3,872,886 | 3/1975 | Shotmeyer | 137/558 |
| 4,296,723 | 10/1981 | Aidrich | 123/510 |
| 4,372,847 | 2/1983 | Lewis | 123/510 |
| 4,585,022 | 4/1986 | Haas | 137/558 |
| 4,795,556 | 1/1989 | Brotea | 123/510 |
| 4,814,087 | 3/1989 | Taylor | 123/510 |

FOREIGN PATENT DOCUMENTS

| | | | |
|---|---|---|---|
| 3308378 | 10/1983 | Fed. Rep. of Germany | 123/510 |
| 1556443 | 11/1979 | United Kingdom | 137/558 |

*Primary Examiner*—Carl Stuart Miller
*Attorney, Agent, or Firm*—Larson and Taylor

[57] ABSTRACT

A device for eliminating the water present in the diesel oil supplying a diesel engine of a vehicle, comprises a water separating member, means for detecting the passage of a warning threshold by the volume of water separated and an electric pump adapted to drain this water through a non-return valve. Said pump is only energized from the battery of the vehicle during periods of preheating the engine and when the abovesaid warning threshold is exceeded.

4 Claims, 1 Drawing Sheet

DEVICES FOR ELIMINATING WATER FROM DIESEL OIL SUPPLYING A DIESEL ENGINE

Figure 1:
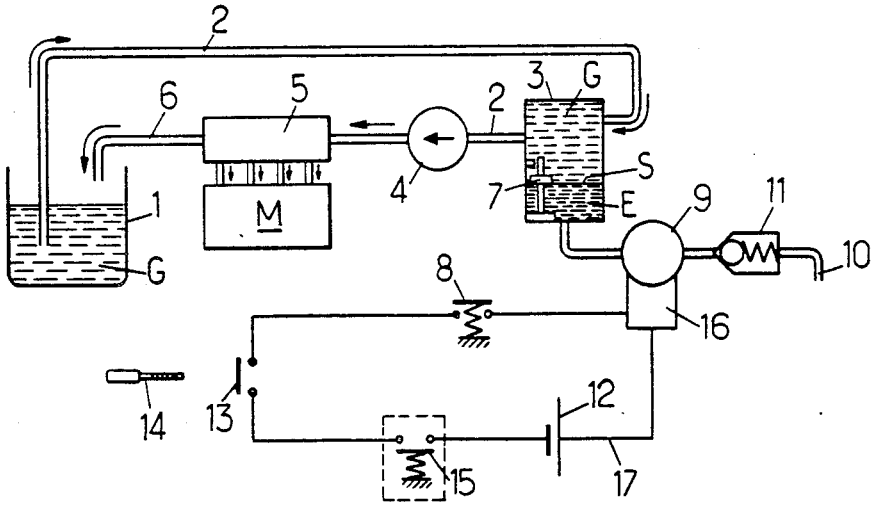

The invention relates to devices designed to eliminate water present in diesel oil supplying a vehicle diesel engine.

It relates more particularly, among these devices, to those which comprise a water-separating member mounted in the diesel oil supply circuit of the engine, a collector for the water separated from the diesel oil and means for detecting when a predetermined warning threshold is exceeded by the volume of separated water received in said collector.

In known embodiments of these elimination devices, the detector means are arranged so as to warn the driver of the vehicle whenever this limiting volume is exceeded.

This warning is manifested particularly by the lighting of a warning light on the dashboard of the vehicle.

The driver must then empty the collector charged with water in order that the separator may efficiently continue its operation, which is conditioned by a sufficient capacity of the container for collecting the separated water.

This formula has many drawbacks.

In fact, the handling necessary to empty the water from the container is fastidious and messy, especially considering that this container is difficult of access.

Moreover, it frequently happens that, precisely by reason of the difficulties indicated, the user delays the required emptying from the beginning of the warning, which runs the risk of affecting the quality of purification of the diesel oil from the water, and even of reintroducing the water into the diesel oil if the volume of water occupying the container becomes excessive.

It has scarcely been contemplated until now to render the emptying concerned automatic by means of an electrically driven pump.

Such a proposal has certainly been made in the document DE-A-2 436 080, but it has not resulted in satisfactory products and it may be thought that this was in particular for the following reason: the electrical circuit of the dashboard of a vehicle, capable of supplying the electrical energy required to supply such a pump, is only generally energized, by means of an ignition key, when the engine is operating. Now it is imperative that the engine should not operate when the emptying of the above container is effected, in order to avoid any risk of suction by this engine, of the water which is then placed in contact with the open air and even of aspiration of this air itself.

This being the case, Applicant has observed that the directions for use of diesel engines stipulate, on each cold start of such an engine, a special operational phase, called "preheating" phase, corresponding to the electrical supply of starting plugs or heater plugs, in the course of which the two following conditions are fulfilled:

energizing of the electrical circuit of the vehicle, absence of operation of the engine, The invention consists of exploiting these privileged preheating periods set to ensure the automatic emptying of the container by means of an electric pump.

More precisely, the water eliminating devices of the above type according to the invention comprise also an electrical drainage pump whose intake is connected to the above container and output, to an evacuation pipe equipped with an non-return valve and an electrical energizing circuit for this pump comprising an electric switch associated with the above detection means, which are arranged so as to close it automatically when the warning limit is reached or exceeded by the volume of water collected in the container, and they are essentially characterized in that the electric energizing circuit of the pump comprises a second electric switch mounted in series with the first, arranged so as to be closed on the energizing of the electrical circuit of the vehicle, and associated with means adapted to neutralize automatically its closure at the latest at the moment of starting up of the engine In preferred embodiments, recourse is had in addition to one and/or other of the following features:

- the means for neutralizing the closure of the second switch are synchronized with those generally provided to indicate the end of the preheating periods of the engine,
- the means for neutralizing the closure of the second switch comprise a third switch in series with the two first ones,
- in a device according to the preceeding paragraph, the means for neutralizing the closure of the second switch are time-delay means.

The invention comprises, apart from these main features, certain other features which are preferably used at the same time and which will be more explicitly considered below.

In the following, one embodiment of the invention will be described with reference to the accompanying drawing given of course as non-limiting.

Figure 2:
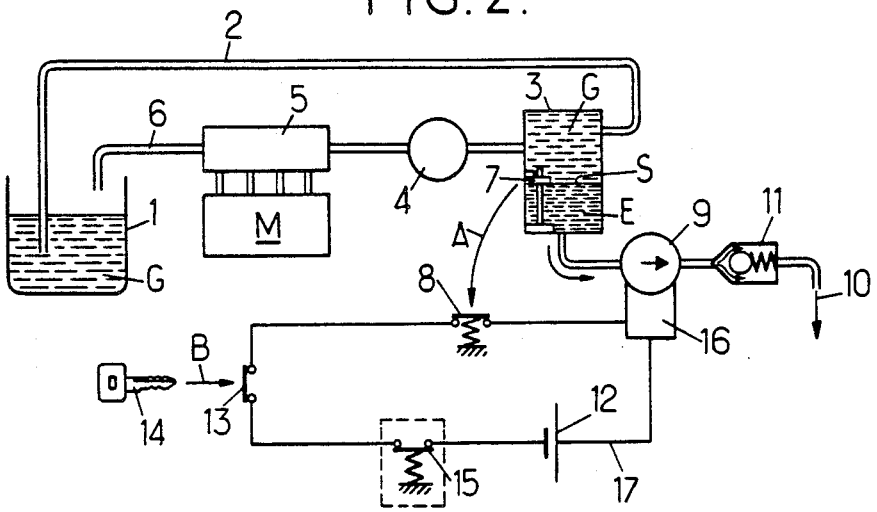

FIGS. 1 and 2 of this drawing show a device constructed according to the invention to eliminate the water contained in the diesel oil supplying a vehicle diesel engine, respectively in the course of normal operation of the vehicle and in the course of draining of water, with the engine stopped.

In a manner known in itself, the water eliminating device comprises:

- a tank 1 for diesel oil G,
- a supply pipe 2 joining this tank 1 to the engine M of the vehicle,
- a decanter 3 adapter to separate the water E contained in the diesel oil G,
- a diesel oil propelling pump 4,
- a pump 5 for injecting diesel oil into the different cylinders of the engine M,
- and a return pipe 6 to tank 1 for the excess diesel oil which has not been consumed in the engine.

The water E, which is heavier than the diesel oil G, collects at the bottom of the decanter 3, which is especially in the form of a vertically elongated container or tank.

A float 7 whose specific gravity is comprised between that of water and that of diesel oil floats on the surface S separating these two liquids in the tank 3.

This float 7 is arranged so as to activate magnetically the movable electric contact of a switch 8 outside said tank.

To this end, it advantageously bears a small permanent magnet capable of acting on said movable contact through a fluidtight a magnetic portion of the wall of the tank 3.

This actuation is such that switch 8 is closed (see arrow A in FIG. 2) when a predetermined level is reached or passed in the ascending direction by the surface S.

In known embodiments, this closure is manifested by a signal such as the lighting of a signal light on the dashboard of the vehicle.

In the case of the present invention it is no longer taken as sufficient to warn the driver of the vehicle of the need for his intervention: the necessary draining of the water E collected in the tank 3 follows automatically when the level of the surface S is reached or passed, that is to say when the volume of water separated and collected in the tank reaches or passes a predetermined level.

For this purpose, recourse is had to an electric drainage pump 9 whose intake is joined to the base of the tank 3 and whose outlet is joined to the open air at 10 through a non-return valve 11 suitably tared.

Said non-return valve 11 must be selected so as to ensure normally a strictly fluidtight closure of the outlet from the pump 9, even a long time.

The tare pressure of this valve is of course adjusted according to need.

Its value depends in particular on the position of mounting the supply pump 4 in the pipe 2, said value being, for example, 0.5 bar for the assembly illustrated and being greater—and for example equal to 2 bars—in the case where said pump would be mounted rather upstream of the tank 3 than downstream of this tank.

The electrical supply of the pump 9 is effected by means of a power circuit shown diagrammatically by the rectangle 16 and comprising generally the battery of the vehicle as well as an actuating relay.

The energizing circuit 18 of this relay comprises for its part, in addition to the battery 12 of the vehicle, at least two electric switches in series, namely:

- a first switch which is none other than the switch 8 described above,
- and a second switch 13 whose closure is automatically triggerable by the ignition key 14 of the vehicle, when this key is manipulated so as to energize at least a portion of the electrical circuit of this vehicle (Arrow B in FIG. 2).

In addition safety means are provided to neutralize the closure of the second switch 13—that is to say to open the switch or to mount in series with it a third opened switch—at least when the engine M of the vehicle operates.

As a matter of fact it is important that this engine remains stopped when water is drained from the tank 3 to avoid any risk of sucking water and/or air into the engine. In other words, the effective duration of "closure" of the second switch 13 must be limited to a period subsequent to the energizing of the electrical circuit of the vehicle and in the course of which the engine M of this vehicle does not operate, which period may be relatively short, for example of the order of only ten seconds.

Now, as it is known, the periods corresponding to this double requirement of energization and stopping of the engine are precisely foreseen during cold starts of diesel engines, in order to preheat the combustion chambers of these engines by means of special plugs.

The invention takes advantage of the existence of these preheating periods to effect the desired automatic drainages.

The safety means can then be the time-delay means, generally servo-coupled to the temperature of a suitable element, which are already provided to inhibit the starting up of a diesel engine cold and so as only to permit such starting after preheating of this engine, said means being triggered by the closure itself of the switch 13.

They could also be very simply constituted by an independant delay circuit adapted to delay the opening of a third switch 15 mounted in series with the two first ones, 8 and 13 in the circuit 17, during a given delay comprised within the preheating period and starting with each closure of the switch 13.

In each case, at the end of the "preheating" period or of the independant delay, the closure of the switch 13 is neutralized, either by its own opening, or by opening of the switch 15.

In the case of the switch 15, the delayed opening concerned is actuated automatically at the expiration of the period concerned.

In the case of the switch 13, the delayed opening is left to the initiative of the driver of the vehicle, the end of the period concerned then being brought to his attention, particularly by lighting up of a luminous signal light on the dashboard of the vehicle, as is well known for indicating the end of the preheating periods of diesel engines.

It is however to be noted that, even in this case, the delayed opening concerned is automatically ensured at least at the moment when the driver puts the engine of the vehicle into operation.

In such a case, for example, the closure of the second switch 13, then its opening, are ensured respectively by bringing the ignition key 14, after its axial insertion into its housing, into two successive stable positions of its angular travel, namely:

- a first position corresponding to the energization of a portion at least of the electrical circuit of the vehicle (FIG. 2),
- and a second position corresponding to the starting up or the operation of the engine (FIG. 1).

The time delay or safety period mentioned above is then that which separates the subsequent bringing of the key 14 into these two positions, the safety or time delay means then being formed by the driver of the vehicle himself, who is placed in a waiting posture with the mission of watching for the signalling of the end of the safety period.

The first switch 8 is arranged not only so as to be closed when the surface of separation S in the tank 3 passes a predetermined level, as explained above, but also so as to be opened again when this surface in descending reaches a level corresponding to the end of the drainage of the water E.

The operation of the device for eliminating water described above is as follows.

In the most general case, the water level in the tank 3 is below the critical threshold so that the switch 8 remains open and the drainage device is neutralized.

The operation of the engine M is then normal when it is supplied with diesel oil according to the arrows seen in FIG. 1.

When the critical limit is reached by the level of the surface S, the switch 8 closes, as indicated symbolically by the arrow A in FIG. 2.

However the drainage of water from the tank 3 is not ensured immediately for all that, since when the engine operates, the switch 13 is open.

The automatic drainage only intervenes in the course of the cold start-up period of the engine consecutive to said closure of the switch 8.

In fact, as explained above, this starting up brings into operation a preheating period in the course of which the switch 13 is closed, as well as the switch 15 if the latter is provided.

Under these conditions, the relay of the circuit 16 is actuated, which closes the circuit, the drainage pump 9 is placed in rotation and the water E is drained from the tank 3, into 10, through the non-return valve 11.

The end of drainage is manifested by a further opening of the switch 8, which stops the pump 9 until the following drainage.

Of course, if the engine of the vehicle is placed in operation before the end of the drainage, the switch 13 is immediately opened and the drainage interrupted.

As a result of which, and whatever the embodiment adopted, there is finally obtained a device permitting the automatic drainage of water separated from the diesel oil, of which device the constitution, the operation and the advantages, particularly the automatic nature and the safety, result sufficiently from the foregoing.

As is self evident, and as results besides already from the foregoing, the invention is in no way limited to those of its methods of use and embodiments which have been more especially envisaged; it encompasses thereof, on the contrary, all modifications.

I claim:

1. Device for eliminating water present in diesel oil supplying a diesel engine of a vehicle, comprising a water separating member mounted in the diesel oil supply circuit of the engine, a container for the water separated from the diesel oil, means for detecting the passage of a predetermined warning threshold by the volume of separated water collected in said container, an electric drainage pump whose inlet is connected to the container and the outlet to an evacuation pipe equipped with a non-return valve and an electrical energizing circuit for this pump comprising an electric switch associated with the above detection means, which are arranged so as to close it automatically when the warning threshold is reached or passed by the volume of water collected in the container, characterized in that said electrical energizing circuit for the pump comprises a second electrical switch mounted in series with the first, arranged so as to be closed on the energization of the electrical circuit of the vehicle, and associated with means adapted to neutralize automatically its closure at the latest at the moment of starting up of the engine.

2. Water eliminating device according to claim 1, wherein the means for neutralizing the closure of the second switch are synchronized with those generally provided to indicate the end of the preheating periods of the engine.

3. Water eliminating device according to claim 1, wherein the means for neutralizing the closure of the second switch comprises a third switch mounted in series with the two first ones.

4. Water eliminating device according to claim 3, wherein the means for neutralizing the closure of the second switch are time delay means.

* * * * *